US005648108A

United States Patent [19]

Hvidegaard

[11] Patent Number: 5,648,108

[45] Date of Patent: Jul. 15, 1997

[54] PRODUCTION SYSTEM FOR AUTOMATIC CASTING OF HOLLOW BODIES, IN PARTICULAR OF CONCRETE

[75] Inventor: Johannes Hvidegaard, Brenderslev, Denmark

[73] Assignee: Pedershaab A/S, Brønderslev, Denmark

[21] Appl. No.: 454,377

[22] PCT Filed: Dec. 8, 1993

[86] PCT No.: PCT/DK93/00415

§ 371 Date: Aug. 7, 1995

§ 102(e) Date: Aug. 7, 1995

[87] PCT Pub. No.: WO94/13448

PCT Pub. Date: Jun. 23, 1994

[30] Foreign Application Priority Data

Dec. 9, 1992 [DK] Denmark ..... 1481/92

[51] Int. Cl.[6] ..... B28B 21/06

[52] U.S. Cl. ..... 425/426; 249/65; 249/100; 425/262; 425/427; 425/457

[58] Field of Search ..... 425/262, 426, 425/427, 438, 443, 457; 249/100, 65

[56] References Cited

U.S. PATENT DOCUMENTS

| | | | |
|---|---|---|---|
| 3,696,182 | 10/1972 | Joelson | 264/72 |
| 3,942,936 | 3/1976 | Wells et al. | 249/100 |
| 4,305,564 | 12/1981 | Jensen | 249/100 |
| 4,449,912 | 5/1984 | Ogura | 249/100 |
| 4,708,621 | 11/1987 | Schmidgall et al. | 425/195 |
| 5,238,384 | 8/1993 | Hartmann et al. | 249/100 |
| 5,286,440 | 2/1994 | Beacom | 249/100 |

FOREIGN PATENT DOCUMENTS

| | | |
|---|---|---|
| 1584595 | 1/1970 | Germany . |
| 388166 | 6/1965 | Switzerland . |
| WO90/05051 | 5/1990 | WIPO . |

*Primary Examiner*—James P. Mackey

*Attorney, Agent, or Firm*—Finnegan, Henderson, Farabow, Garrett & Dunner

[57] ABSTRACT

A production system for automatically casting hollow bodies, in particular of concrete, in a casting mold, which comprises an inner mold (2), an outer mold (1), a bottom ring (3), and a top ring (4). Separate top rings (4) are used for the production, which remain on the top end of the pipe until the concrete has set sufficiently, to ensure that the shape and tolerances of the top end of the pipe are retained after casting. The system moreover includes a clamping chuck (15) for retaining the top ring during casting. The clamping chuck is equipped with a clamping device that includes a ring-shaped flexible hose and a slotted spring ring. When the hose is filled with compressed air from a compressed air source, it clamps the spring ring together around a gripping ring on the top ring.

13 Claims, 11 Drawing Sheets

PRODUCTION SYSTEM FOR AUTOMATIC CASTING OF HOLLOW BODIES, IN PARTICULAR OF CONCRETE

BACKGROUND OF THE INVENTION

The invention concerns a production system for automatic casting of a hollow body, in particular of concrete, and comprising an inner mould which may be stationary or rise vertically during casting; an outer mould which can be displaced vertically up and down between a lower casting position and an upper free position; a bottom ring for supporting the hollow body and forming a mould part for the lower end part of the hollow body; a top ring for forming a mould part for the upper end part of the hollow body; and a gripper for positioning the top ring in the casting position and retaining it during casting.

Today concrete pipes and other hollow bodies to be manufactured in large numbers with a uniform and constant quality are generally cast in automatically operating production systems of the above-mentioned type. A typical system comprises a mould machine having functions for vertically displacing the outer mould and usually also the inner mould or the core vertically up and down. The machine moreover has a table on which the bottom ring, which simultaneously serves as a pallet for the finished pipes, is placed at the beginning of a production cycle. When the outer mould has been lowered and stands on the bottom ring, the mould is filled from above with fresh concrete. In those cases where a vertically displaceable inner mould is used, this is simultaneously caused to rise from below so as to successively define a ring gap between the two mould parts for forming of the pipe wall. During this casting process the concrete is subjected to vibrations by means of one or more vibrators, which are present in the inner mould in most cases.

In a very widely used method the upper end or spigot end of the hollow body is formed by pressing a profile ring down against the upper side of the concrete when the mould has been filled and the inner mould is present in its upper position. After this operation stripping of the pipe is initiated, the inner mould being pulled down and the outer mould up. During this operation the profile ring remains in its lower pressing position to prevent the pipe from being pulled apart completely or partly by the rather considerable, upwardly directed friction forces to which the outer mould subjects the pipe. Then the profile ring is lifted clear of the pipe, which can now be removed by means of a transport carriage or crane which drives the pipe out to a location for setting.

During setting the pipe remains standing on the bottom ring, which, as previously mentioned, forms a mould part for the lower end or socket end of the pipe, which thus retains its shape and the prescribed tolerances with certainty. Since the profile ring is not carried along, but remains in the machine, the shape of the spigot end, on the other hand, will not be retained during the transport and the setting process without means being provided for this purpose. It has been found that such free spigot ends on newly cast pipes tend to become oval or collapse before the concrete has obtained a sufficient stability and strength. To ensure the dimensional stability of the spigot end as well, a separate top ring is therefore usually placed on the spigot end immediately after casting. This top ring, which is frequently of plastics, can advantageously have walls which support the spigot end interiorly as well as exteriorly. When the pipe, e.g. after one day, has set sufficiently, the top ring is removed again.

These top rings require performance of not insignificant manual labour in the otherwise fully automatically proceeding process. To this should be added that the positioning of the top rings on the spigot ends involves a serious risk, since the spigot end can easily be damaged during this operation if extreme care is not shown.

To avoid these drawbacks, a known automatic production system employs loose top rings, which are of steel and form a mould part for the spigot ends during casting in the normal manner. Instead of being pulled clear of the finished pipe, as before, the top ring is now left on the spigot end and remains on it until the concrete has set sufficiently. Then the top ring is knocked off and is used again in a subsequent production cycle.

For also the operations necessary for this purpose to be performed automatically, a gripper is incorporated in the production system for fetching the top ring from e.g. a magazine, positioning it in the casting position and retaining it there during casting. This gripper has a central opening through which the mould can be filled with fresh concrete. The gripper is moreover provided with a plurality of claws for gripping some corresponding, upwardly directed gripping parts which are secured on the top side of the top ring. Each claw is activated by a pneumatic or hydraulic drive cylinder, which extends radially outwardly from the circumference of the gripper. This structure entails that the extent of the gripper transversely to its axis will exceed the internal diameter of the outer mould at any rate at the drive cylinders. Because of the size of the gripper it must be positioned above the outer mould during casting. For the same reason the outer mould cannot pass upwards around the gripper during stripping, and the gripper must therefore necessarily first be removed from the path of the outer mould.

This entails that the gripper is not capable of providing any support for the upper end of the pipe during the very critical stripping of the outer mould. In practice, the method can therefore only be used for e.g. well rings having a small height and a large thickness, while slender pipes, which may e.g. have a length of 3000 mm, a diameter of 300 mm and a thickness of the shank of 65 mm, cannot be cast in this manner. In this case, the frictional force involved in the stripping of the outer mould would be greater than the tensile forces which the non-set, newly cast concrete could stand.

Accordingly, there is a need for a new and improved automatically operating production system of the type mentioned in the opening paragraph for casting of hollow bodies, such as concrete pipes, which, via a loose top ring, is adapted to provide support for a hollow casting during stripping of the outer mould and to allow the top ring to remain in unchanged position on the casting until this has set sufficiently on the setting location.

SUMMARY OF THE INVENTION

The novel and unique features achieving this are that the top ring is equipped with a cylinder Jacket-shaped gripping ring whose lower end is secured to the top ring and upper end is free; that the gripper is in the form of a clamping chuck having a reception opening for the gripping ring and means for clamping it; that the greatest transverse dimension of the chuck is smaller than the internal diameter of the outer mould; and that the chuck can be displaced vertically up and down between a lower casting position and an upper free position. During stripping this structure permits the outer mould to pass freely upwards around the clamping chuck, which can therefore be left to retain the top ring in the casting position. In this manner the top ring will serve as a support for the hollow casting which is thereby effectively protested against being pulled apart completely or partially during stripping.

In a preferred embodiment the clamping means comprise a ring-shaped, flexible hose which is arranged substantially co-axially inside the chuck where it is supported by an inwardly directed engagement face; a pressure source for expanding the hose by a pressure fluid; a spring ring which has an open transverse slot along part of the periphery, and which is biassed by a spring force expanding the spring ring to engage the hose by pressure action, said transverse slot being at any rate so wide as to allow the spring ring to be squeezed about a gripping ring in the expansion of the hose, said gripping ring being received in the reception opening of the chuck. The radial extent of the clamping means is hereby so small that the chuck in transverse dimension may be constructed with the limitations involved by the internal diameter of the outer mould, while the chuck is capable of effectively retaining the gripping ring in a firm and safe grip during casting and the subsequent stripping process. The structure of the clamping means moreover entails that the chuck can rapidly and completely smoothly release the gripping ring of the top ring, since the spring ring at the same time presses the fluid out of the hose along the entire circumference when the pressure in the hose is releaved. This prevents the chuck from accidentally pushing the top ring and deforming the top end via the top ring when the chuck releases the top ring.

To additionally ensure that the chuck releases the top ring completely smoothly, a valve may be interposed between the pressure source and the hose for alternately connecting the hose with either the high pressure side or the low pressure side on the pressure source, and at any rate the valve connection to the low pressure side may have a considerably smaller flow area than the area of a cross-section of the hose in the expanded state. The constricted area at the valve connection of the low pressure side ensures that practically the entire pressure drop, when the pressure is relieved, takes place via this valve connection, so that no pressure difference of importance can occur between the various areas of the hose along the circumference.

The spring ring may be positioned loosely in the chuck without being firmly connected with it at any place, so that the spring ring will automatically assume a correct position in the chuck during the gripping process. The gripping ring is preset in a position in which is does not tend to push the top ring when this is released by the chuck.

However, in an expedient embodiment the spring ring may also be secured to a firm part of the chuck at an area positioned diametrically opposite the slot, and this firm part may be aligned with the valve connection.

When the pressure in the hose is relieved, the spring ring in this case expands resiliently in a uniform manner at either side of the attachment area. The hose is must vulnerable at the valve connection, but the attachment part contributes to safeguarding the hose at this location by restricting its movements.

To safeguard the hose also along its complete circumference an upwardly directed engagement face is provided in the chuck to support the spring ring, which thereby transfers the weight from a received top ring directly to the firm parts of the chuck and not via the hose, which would thereby be subjected to a considerable load that would lead to rapid wear of the hose necessitating frequent replacements.

In these systems the mould is filled with fresh concrete which therefore has to pass through the chuck. To prevent concrete from penetrating into the clamping means of the chuck, which might thereby be caused to fail, the reception opening of the chuck is ring-shaped and inwardly defined by a protecting ring having a greater free height than the gripping ring and a smaller outside diameter than the inside diameter of the gripping ring. During the passage of the concrete the protecting ring safeguards the interior of the chuck against ingress of the concrete.

To prevent the hose from being squeezed into the transverse slot of the spring ring during expansion such that the spring ring cannot close about a received gripping ring, a relatively thin-walled ring section may be arranged on the outer side of the spring ring over its transverse slot.

In an advantageous embodiment of the top ring the upper side of said top ring may have secured to it a plate ring which in turn carries the gripping ring and has a preferably obliquely outwardly and upwardly protruding free edge flap, which can be used on the setting location for knocking off the top ring.

Production systems of this type are generally very big, and it is therefore possible that humans are present directly below a chuck with a squeezed top ring in certain parts of the production cycle. If in this case the pressure of the pressure source should fail, the chuck would open, and the heavy top ring would fall down and hit such humans who might then be severely injured. To avoid this, at least one catch may be provided at the outer periphery of the chuck, which is kept in position by spring action below the edge flap on a top ring, whose gripping ring is received in the chuck, and can be moved out of this position by a pressure fluid drive cylinder by opening of a separate valve connecting the drive cylinder with the pressure source of the hose. If the pressure fails, then the catch cannot be moved out of its position below the edge flap. Even though only a single catch is provided, the top ring will therefore remain in its position with the gripping ring clamped obliquely in the chuck.

Systems of this type frequently comprise a vertically slidable filling pipe with a smaller outside diameter than the inside diameter of the outer mould and a lateral opening for introducing casting material. In this case the chuck may advantageously be secured downwardly on this filling pipe.

Generally also a transport means is provided, e.g. a pipe crane for removing the cast pipe. As part of the fully automatic process the pipe crane may have a pipe shelf on which a loose top ring may be put, said top ring being thereby automatically moved into position below the chuck when the fork is present in the lifting position below the bottom ring. In a separate movement the chuck can then descend to fetch the top ring, while the transport means lifts the finished pipe from the table of the machine.

BRIEF DESCRIPTION OF THE DRAWINGS

The invention will be explained more fully by the following description of an embodiment, which just serves as an example, with reference to the drawing, in which.

DETAILED DESCRIPTION OF THE INVENTION

Figure 1:
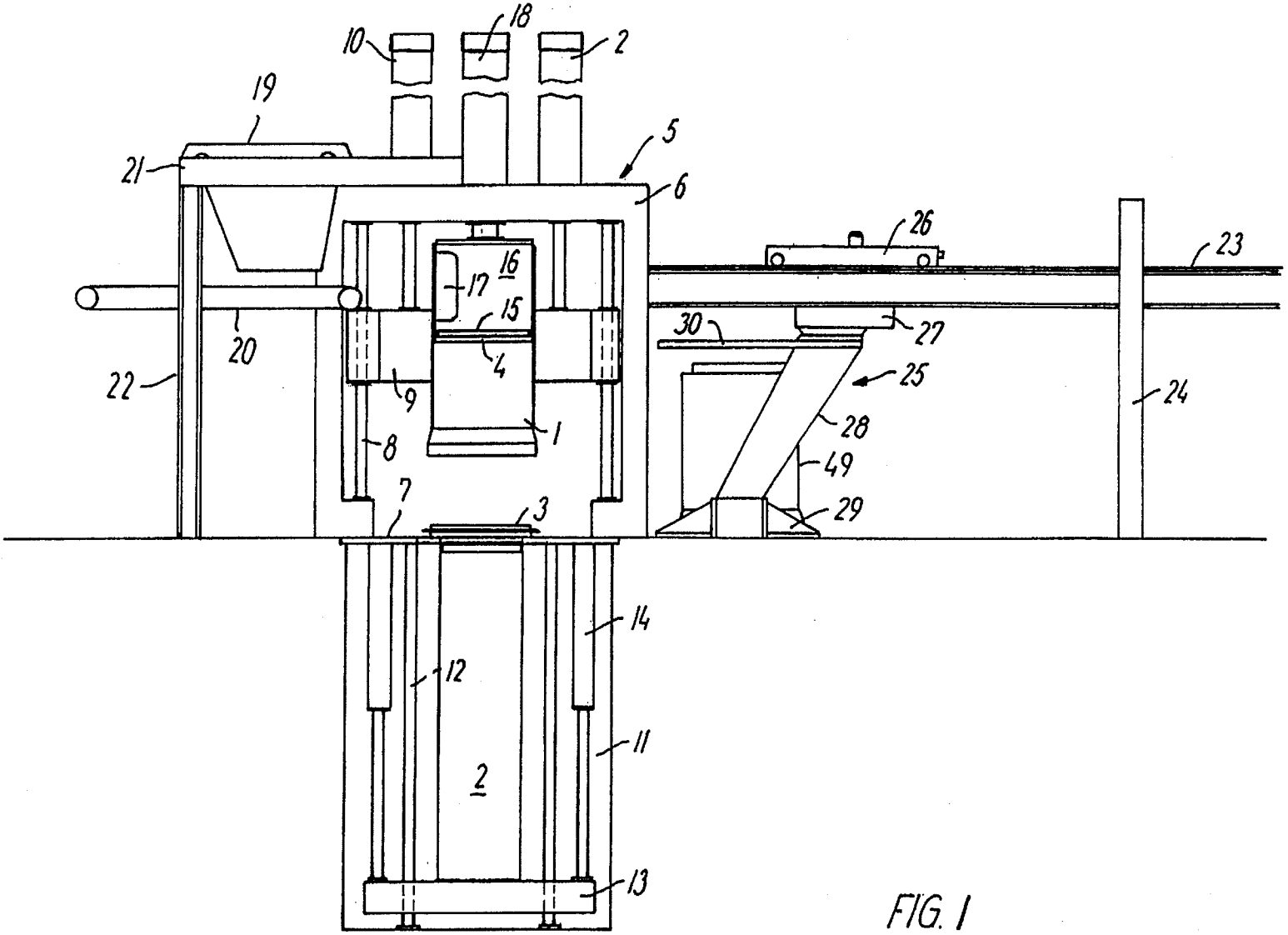
FIG. 1 is a schematic side view, partially in section, of the apparatus of the present invention for casting concrete pipes showing the mold parts in an initial position.

The advantages obtained by means of the apparatus of the invention are particularly pronounced when casting relatively long, slender concrete pipes, which are therefore used below as an example of the type of hollow bodies which are cast in the apparatus shown in FIGS. 1–9. However, this is not to be understood as a restriction in the scope of protection of the invention, since the apparatus or system may equally well be used for all other types of hollow bodies, such as short pipes and well castings, and the hollow bodies may also be made of other forms of casting materials, e.g. sulphur concrete.

In all cases a casting mould is provided, consisting of an outer mould 1, an inner mould or core 2, a bottom ring 3, and a top ring 4. In the shown case both the outer mould and the inner mould may be displaced vertically up and down between a free position in which the two mould parts are pulled completely clear of a cast pipe, and a final casting position in which the two parts together define a ring slot of the shape which the pipe is to have. The bottom ring 3 closes the casting mould downwardly and forms an interior mould part for the pipe socket. The bottom ring moreover serves as a Support and pallet for the pipe. Upwardly the casting mould is closed by the top ring which also forms a mould part for the spigot end.

The four mould parts of the casting mould are arranged in a mould machine which is generally designated by the reference numeral 5. The mould machine has a frame 6 and a table 7. The frame mounts a first set of columns 8 forming a guide for a first crosshead 9 which carries the outer mould 1. Further, a first set of vertically positioned means such as hydraulic drive cylinders 10 are arranged upwardly in the frame, are connected with the crosshead 9 and serve to displace the outer mould 1 vertically up and down via the crosshead. The inner mould 2 is arranged in a pit 11 below the mould machine. This pit accommodates a second set of columns 12 forming a guide for a second crosshead 13 which carries the inner mould 2. A second set of vertically positioned, means such as hydraulic drive cylinders 14, which are arranged in the pit 11, are connected with the second crosshead 13 and serve to displace the inner mould 2 vertically up and down via the crosshead. Loose top rings 4 are used in the system, which are gripped and retained during casting by means of a chuck 15, which will be described more fully below. The chuck is secured downwardly on a filling pipe 16 having a lateral opening 17 for the introduction of the concrete to be filled into the mould. A third vertically positioned means such as hydraulic drive cylinder 18, which is arranged upwardly in the frame 6, serves to displace the filling pipe 16 and thereby the chuck 15 vertically up and down.

A supply funnel 19 having an underlying horizontal conveyor belt 20 is slidable to and fro on a horizontal beam 21, which is supported by i.a. columns 22. A pipe crane 25 can travel to and fro by means of a carriage 26 on another horizontal beam 23, which is supported by i.a. columns 24. Below this carriage there is provided a lifting mechanism 27 which carries two downwardly directed legs 28 each having a fork 29 of its own. The lifting mechanism moreover carries a horizontal shelf 30 on which a top ring 4 fed from a magazine (not shown) is positioned during the production cycle. The bottom ring 3 is placed on the table 7 by means of a feeder (not shown), which fetches the bottom rings from another magazine (not shown).

FIGS. 10–13 are enlarged views of a top ring 4 and a chuck 15. The top ring is preferably made of sheet iron and consists, in the shown case, of a lower mould part 31, a plate ring 32 welded on top of the lower mould part, and a cylinder jacket-shaped gripping ring 33 which is in turn welded on the top of the plate ring. Further, an outer edge flap 34 protruding obliquely outwardly and upwardly is bent on the plate ring.

Figure 11:
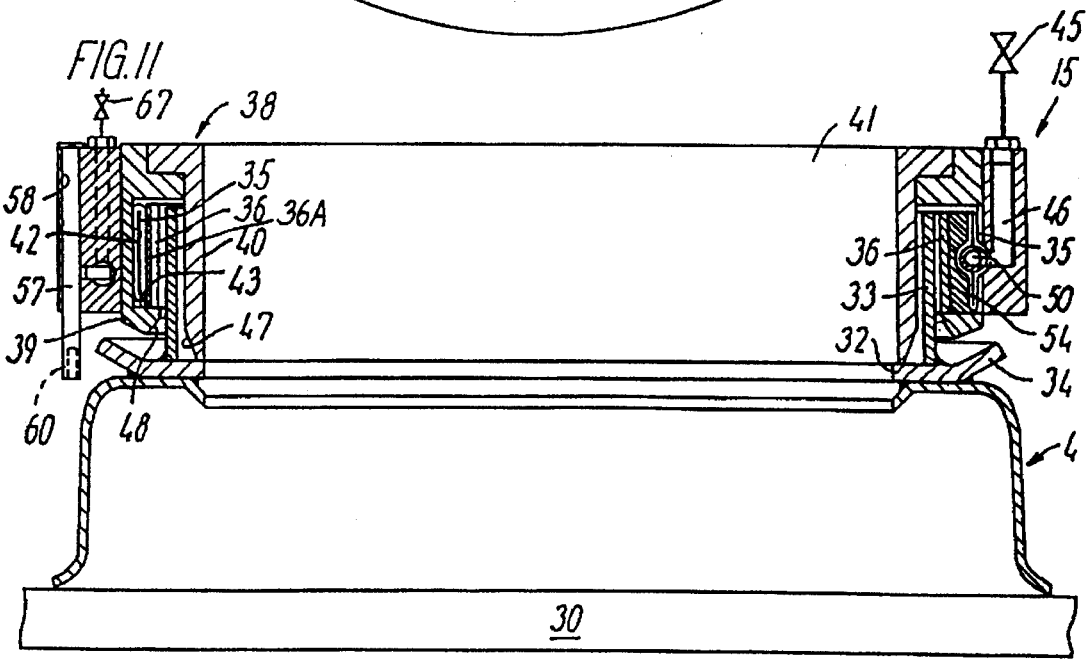
FIG. 11 is a section along the line XI—XI in FIG. 10.
Figure 13:
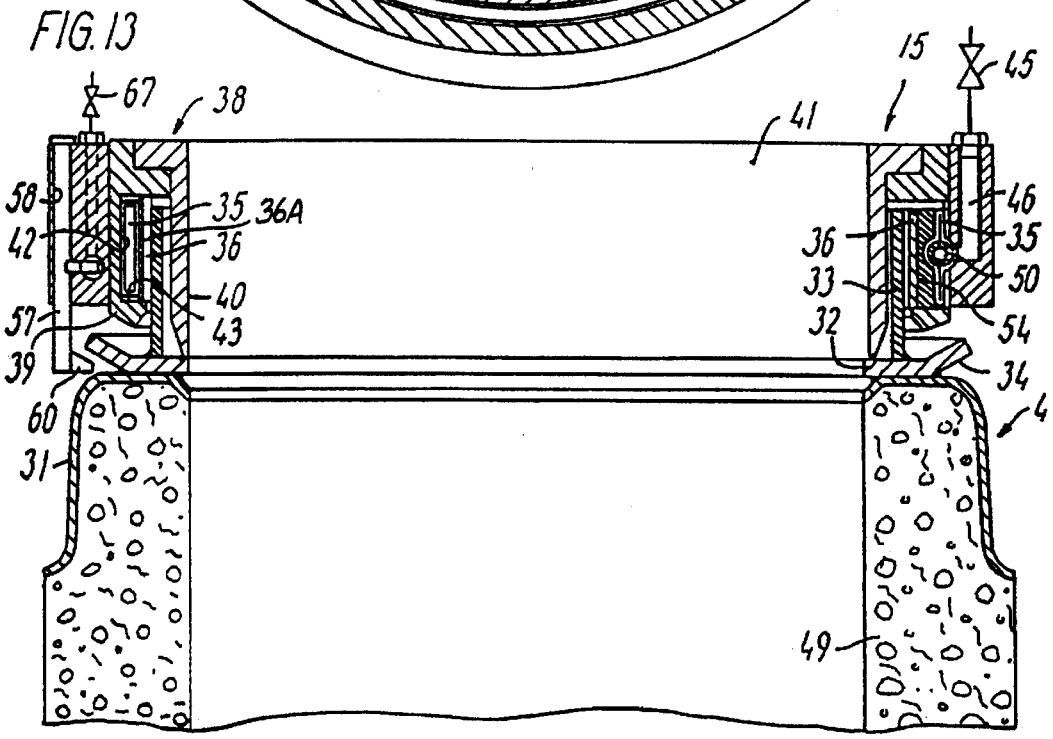
FIG. 13 is a section along the line XIII—XIII in FIG. 12.

The gripper mechanism of the chuck substantially consists of a ring-shaped, flexible hose 35 and a spring ring 36 having an open transverse slot or gap 37. The hose and the spring ring are contained in a housing which is generally designated by the reference numeral 38 and comprises an outer ring 39 and an inner ring 40. The inner ring defines a central opening 41 through which the fresh concrete is directed down into the mould during the casting process. As shown in FIGS. 11 and 13, the inner ring 40 ensures that the concrete does not penetrate into the housing and render the clamping mechanism consisting of the hose 35 and the spring ring 36 more or less inoperative. The outer ring 39 has an inwardly directed engagement face 42 to support the hose 35 and an upwardly directed engagement face 43 to support the spring ring 36. The free opening over the transverse slot 37 is covered by a ring section 36A of thin sheet. The ring section may be secured to the spring ring on one side of the transverse slot so that the spring ring can be squeezed together and expanded again freely.

The flexible hose 35 can be caused to expand when it is supplied with a pressure fluid which is assumed to be compressed air. The compressed air is supplied from a compressed air source (not shown) via a first valve 45 and air channels 46.

Figure 10:
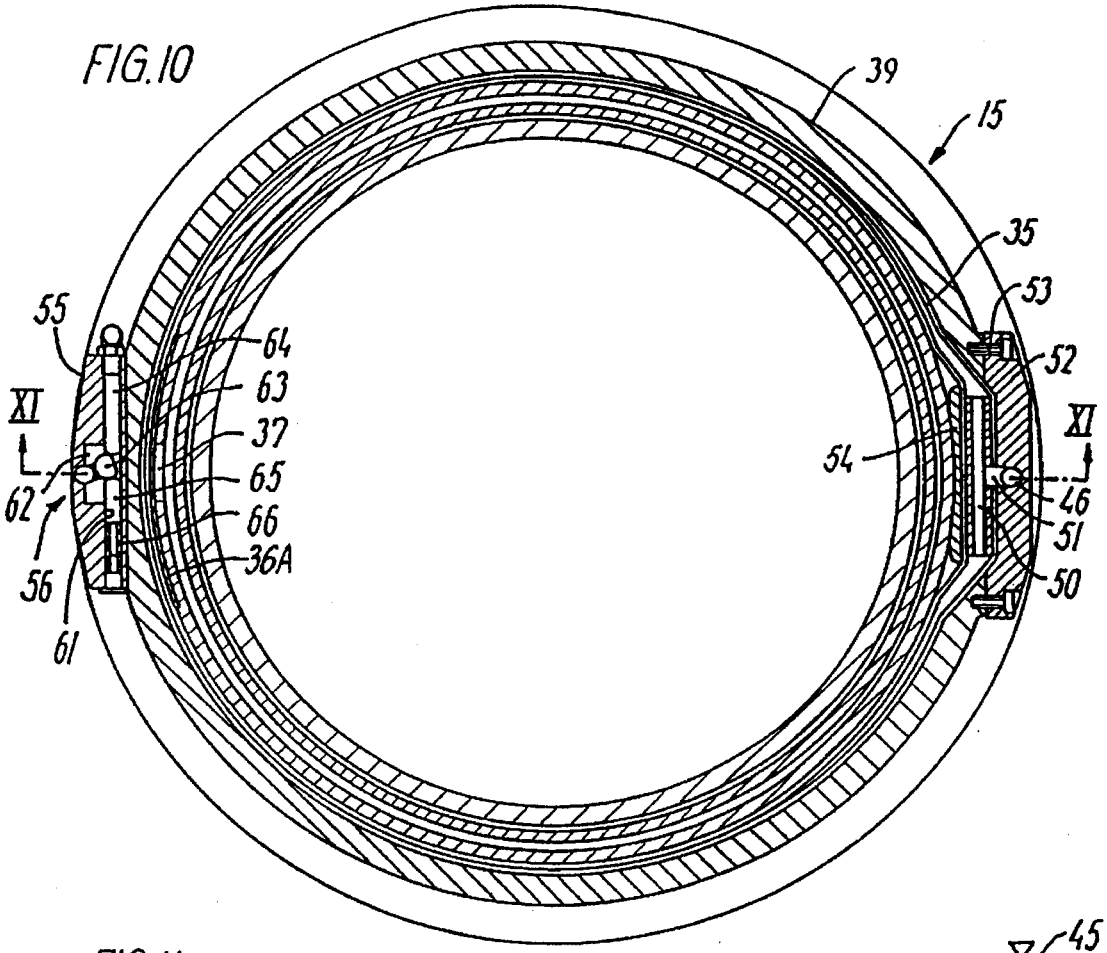
FIG. 10 is an enlarged view of a clamping chuck, associated with the apparatus shown in FIGS. 1–9, in a open position during insertion of a gripping ring onto a top ring.

In FIGS. 10 and 11 the hose has been relieved of its pressure by the opening of the valve 45 to the atmosphere, and the air in the hose is now pressed out by the spring ring 36, since this expands until the hose has been flattened. For this purpose the spring ring is biassed by a sufficiently great spring force. When the spring ring has expanded and flattened the hose, an open slot is formed between the spring ring 36 and the inner ring 40 in which a gripping ring 33 on a top ring 4 can be received. This situation is shown best in FIG. 11, where a top ring 4, placed on the shelf 30 of the pipe crane 25, has been moved inwards below the chuck 15, which has then been lowered over the gripping ring 33 which is now present in the open reception slot of the chuck.

To facilitate the introduction of the gripping ring into the reception slot, each of the inner ring 40 and the outer ring 48 is downwardly provided with a bevel 47 and 48, respectively, so as to form a downwardly directed inlet for safely guiding the gripping ring into position in the reception slot.

The reception slot itself has such a great depth and the inner ring 40 such a height that the lower edge of the inner ring will rest against the upperside of the plate ring 32 on the top ring when the gripping ring 33 of the top ring is received in the reception slot of the chuck. The interior of the chuck is thereby protected against ingress of concrete during the casting process, which might render the clamping mechanism of the chuck inoperative.

Figure 12:
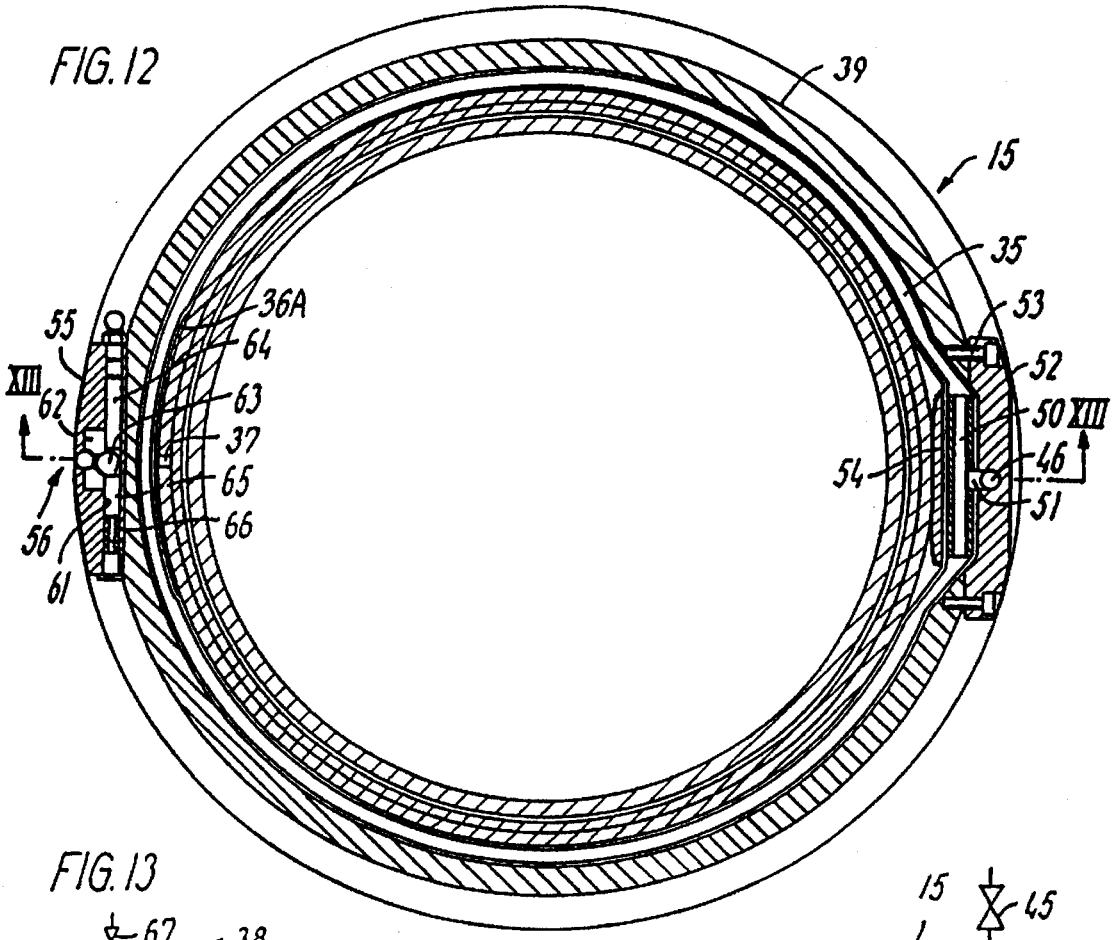
FIG. 12 is a view of the clamping chuck shown in FIG. 10 which has now been squeezed together about the fully received gripping ring.

In FIGS. 12 and 13 the valve 45 has opened to admit the compressed air, which has rapidly filled the hose 35 and pumped it up so that it squeezes the spring ring 36 around the gripping ring 33 of the top ring 4 with a considerable pressure. The chuck can now move the retained top ring downwards and close the casting ring upwards, following which casting of a concrete pipe 49 can take place.

When the finished pipe 49 is to be stripped, the hose 35 is released by opening the valve 45 to the atmosphere, so that the chuck releases the gripping ring 33 and can be pulled clear of the top ring 4, which is left on the concrete pipe and remains on it until the concrete has obtained a sufficient strength after e.g. one day. Then the top ring is removed manually or automatically by means of blows on its end flap 34.

Current production of a specific pipe dimension therefore requires a rather large number of loose top rings. To avoid investing too huge financial resources in these top rings, they are preferably manufactured in a simple and inexpensive manner. Thus, the gripping ring is typically made of plate or flat iron which is rounded and welded together without further treatment. This means that the diameter of the gripping ring will fluctuate within rather wide tolerances. For this reason the outside diameter of the inner ring 40 is dimensioned with a size which is outside the tolerance region of the gripping ring with certainty. The gripping ring is therefore always fixed in the chuck alone by means of the hose and the spring ring 36, which is capable of flexibly adapting to the gripping ring when being squeezed around it.

A short pipe member 50 is positioned in the hose at the location where the air is admitted into the hose. The pipe member and the hose are perforated by an opening 51 through which the hose communicates with the air channels 46, which are connected with the compressed air source via the valve 45. The channels 46 are provided in a clamping member 52 which is mounted on the outer ring 39 of the chuck by screws 53. A vertical rib 54 is arranged in the housing 38 of the chuck opposite the clamping member 52, said rib supporting the rear side of the hose at the pipe member 50 so that the area around the air opening 51 of the hose can be squeezed tightly together between the pipe member 50 and the clamping member 52.

As will be seen, the air opening 51 of the hose and the air channels 46 have a considerably smaller area than the cross-section of the hose in the expanded state. This means that the pressure drop, which occurs when the spring ring presses the air out of the hose, almost exclusively takes place over the air opening 51, the air channels 46 and the connections through the valve 46 to the atmosphere. Therefore, in practice the pressure in the hose is the same along its entire periphery, while the hose is flattened by the spring ring, which thereby releases a gripping ring, received by the chuck, completely smoothly. It is hereby ensured that the chuck, when it is to release a top ring, will not accidentally displace it with respect to the spigot end of the finished pipe, which might be deformed thereby.

In the embodiment shown in FIGS. 10–13 the peripheral part of the spring ring 36 located opposite the slot 37 is secured on the rib 54. This structure contributes to safeguarding the hose against overloading in the particularly vulnerable area at the air connection where the movements of the spring ring and thereby the hose are highly restricted.

If the air pressure fails, the chuck might lose a top ring down over humans who might be present below the chuck. As a safeguard against serious personal injury being inflicted in this manner, a drop safety device, generally designated by the reference numeral 56, is provided in a projection 55 on the outer ring 39 of the chuck. This safety device comprises a shaft 57 which is rotatably mounted in a vertical through hole in the projection 55. Upwardly the shaft has a head 59 which rests on the upper side of the projection 55, and downwardly the shaft has a hook 60 which upwardly has an inclination obliquely adapted to the edge flap 34. A horizontal, transverse through hole 61 is provided at a small radial distance from the vertical hole 58 and is connected with the vertical hole 58 by means of a channel 62. The shaft 57 mounts an almost ball-shaped pin 63 which extends into the transverse hole 61 via the channel 62. A piston 64 is provided in the transverse hole 61 on one side of the pin 63, and a peg 65, which permanently exerts a pressure on the pin 63 from a spring means such as a compression spring 66, is provided on the other side. The piston side of the transverse hole 61 is connected via another valve 67 with, the same pressure source as the first valve 45. The drop safety device 56 operates in the following manner.

When the second valve 67 has closed and the transverse hole 61 has been connected with the atmosphere via the relief opening of the valve, the peg 65, actuated by the compression spring 66 via the pin 63, rotates the shaft 57 into the position shown in FIG. 13 in which the hook 60 is present below the edge flap 34 on a top ring whose gripping ring 33 is received in the reception slot of the chuck. If the air pressure should fail and the chuck therefore releases its grip on the gripping ring, the top ring will nevertheless remain in the chuck, since the hook 60 merely causes the gripping ring 33 to assume an obliquely clamped position in the reception slot. The necessary safety against accidents caused by a dropping top ring can thus be provided by means of merely one drop safety device. However, as desired, the chuck may be readily provided with two or more drop safety devices as an additional safeguard against drop of a top ring.

When the chuck is to grip or release a top ring, the hook 60 is rotated into the position shown in FIG. 11 in which it is now located completely outside the periphery of the edge flap 34. This takes place by opening the second valve 67 to admit compressed air into the piston end of the transverse hole 61, whereby the piston via the pin 63 rotates the shaft 57 against the action of the spring force from the compression spring 66. This operation can take place only if the system is pressurized. In case of pressure failure the hook 60 will always be in the position shown in FIG. 13, where the chuck cannot lose a clamped top ring. The extreme positions of the rotary movements of the shaft 57 shown in FIGS. 11 and 13 are ensured in that the piston 64 and the peg 61, respectively, bottom in the respective ends of the transverse hole 61. The ends are suitably closed for this purpose.

As will appear, all the parts of the chuck, i.e. the outer ring 39, the flexible hose 35, the spring ring 36 and the inner ring 40, has a very small radial extent in crosssection. Consequently, such a chuck can easily be built with so small outer transverse dimensions that the chuck, in contrast to the conventional structures, can now be present inside the outer mould 1, and with such a large central opening 41 that the upper end of the inner mould 2, which extends up into the chuck and closes the mould in the final casting position, can be accommodated. These properties are essential to the operation of the production system, as will be explained below with reference to FIGS. 1–9 in particular.

In FIG. 1 the production system is in the initial phase of a production cycle for the casting of a relatively long and slender concrete pipe 49. The pipe crane 25 is shown driving away with the finished concrete pipe 49 from the just concluded preceding production cycle. The inner mould 2 has been pulled completely down into the pit 11. A bottom ring 3, fetched from a bottom ring magazine (not shown), has been placed on the table 7. The outer mould 1 is on its way down to the casting position, and the same applies to the chuck 15 in which a loose top ring 4 to be used for the casting of the pipe has been clamped.

Figure 2:
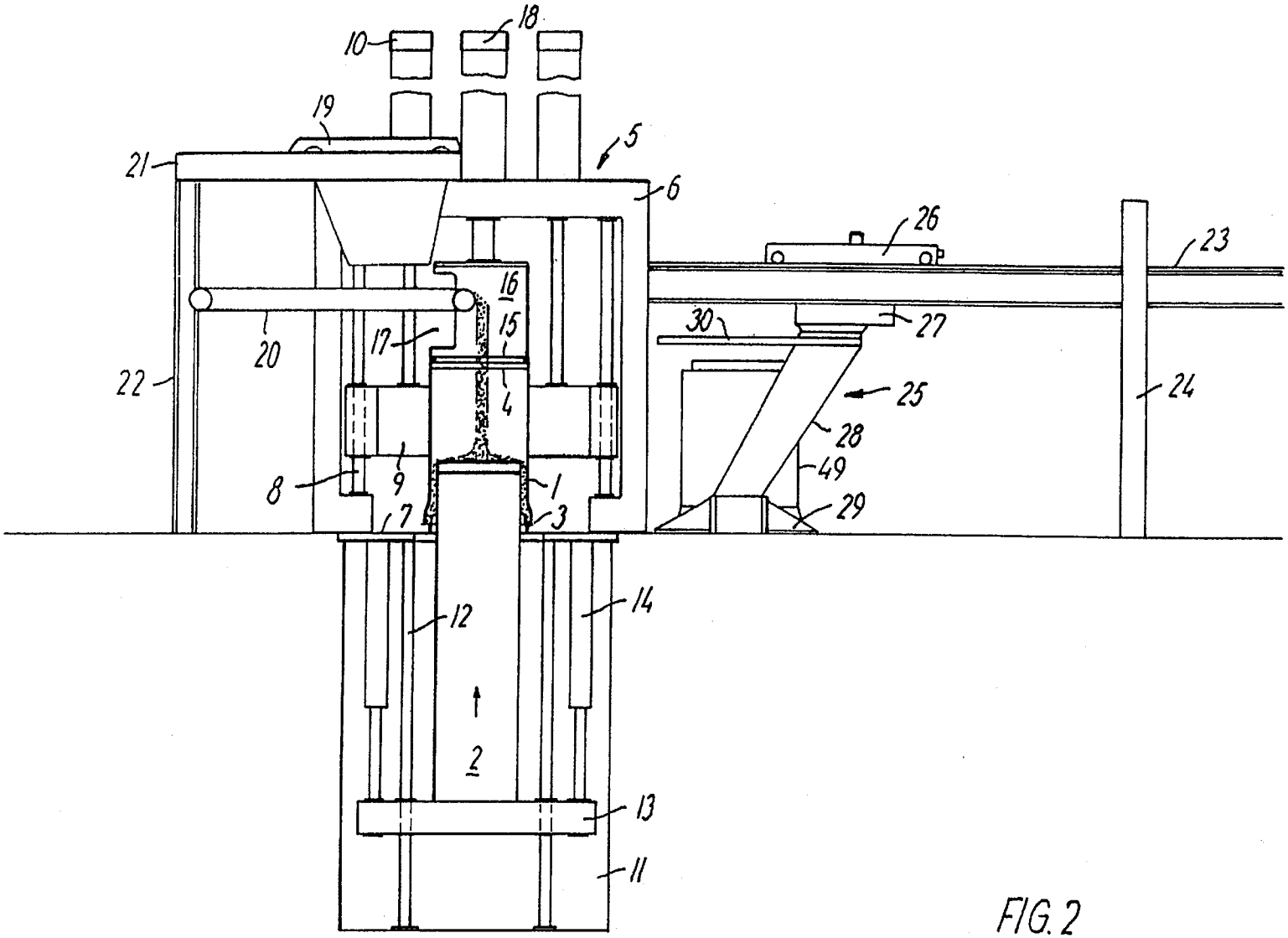
FIG. 2 is a view similar to FIG. 1 showing the mold parts in a casting position.

In FIG. 2 all mould parts are now in the casting position, and the supply funnel 19 and the conveyor belt 20 have been displaced to the right in the figure so that the discharge end of the conveyor belt has been moved through the lateral opening 17 of the filling pipe. Fresh concrete from the supply funnel 19 drops down on the conveyor belt 20, which, as shown, thereby fills the mould, while the inner mould 2 successively rises in the outer mould 1. During this movement the concrete is subjected to vibrations by means of one or more vibrators (not shown) which are arranged inside the inner mould 2.

Figure 3:
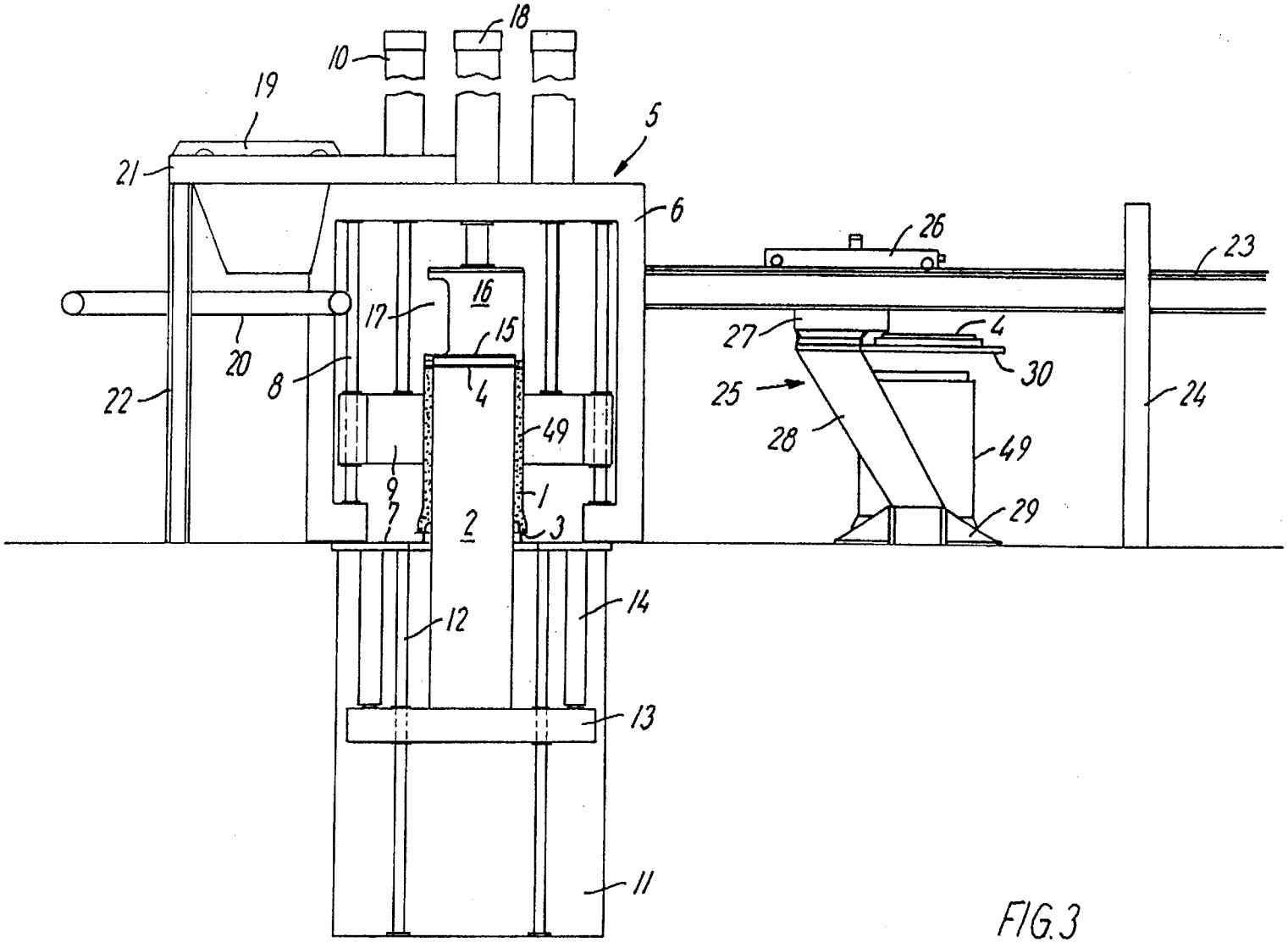
FIG. 3 is a view similar to FIG. 1 showing the mold parts completely filled.

In FIG. 3 the mould has been filled completely, and the supply funnel 19 and the conveyor belt 20 have been retracted to their starting positions to the left of the figure. The inner mould 2 is in its upper position, and the cast pipe 49 is ready for stripping. The legs 28 of the pipe crane 25 have been rotated 180° to discharge the pipe from the last production cycle. A top ring 4 for the subsequent production cycle has moreover been put on the shelf 30 of the pipe crane 25.

Figure 4:
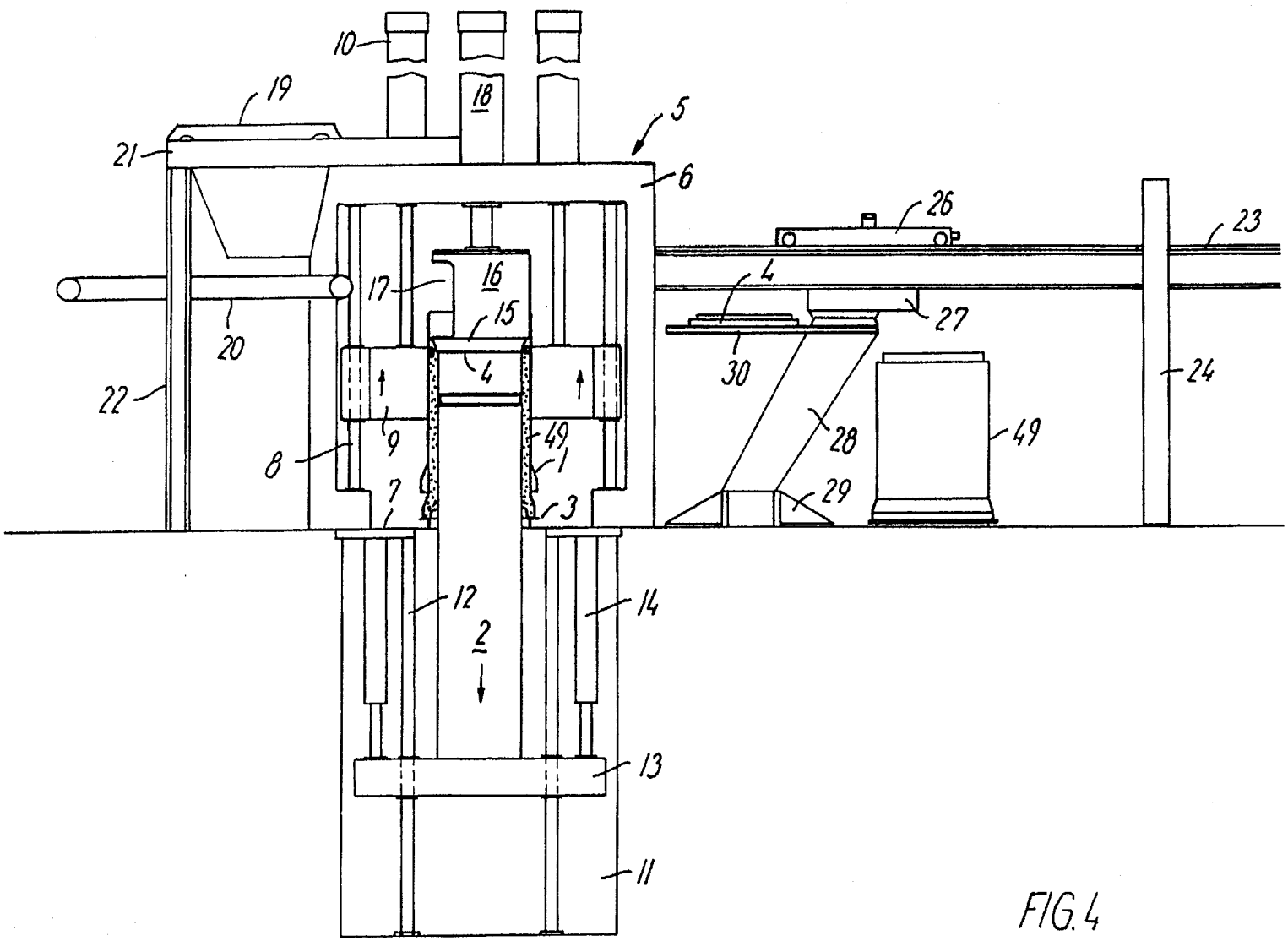
FIG. 4 is a view similar to FIG. 1 showing the mold parts being stripped clear of the cast pipe.

In the next production step, which is shown in FIG. 4, the legs 28 of the pipe crane 25 have again been rotated 180°. The pipe crane stands by, while the inner mould 2 is pulled down into the pit 11, and the outer mould 1 is pulled clear of the cast pipe. During this stripping operation the clamping chuck is left and retains the top ring 4 in the casting position. This is possible because the clamping chuck has such a small transverse dimension that the outer mould can freely pass upwards around the chuck. This provides the very considerable advantage over conventional systems that during stripping of the outer mould the top ring serves as a support for the pipe, which will therefore not be damaged to a greater or smaller extent by the great vertically upwardly directed frictional forces which act on the outer side of the pipe, while the outer mould is pulled off the pipe.

Figure 5:
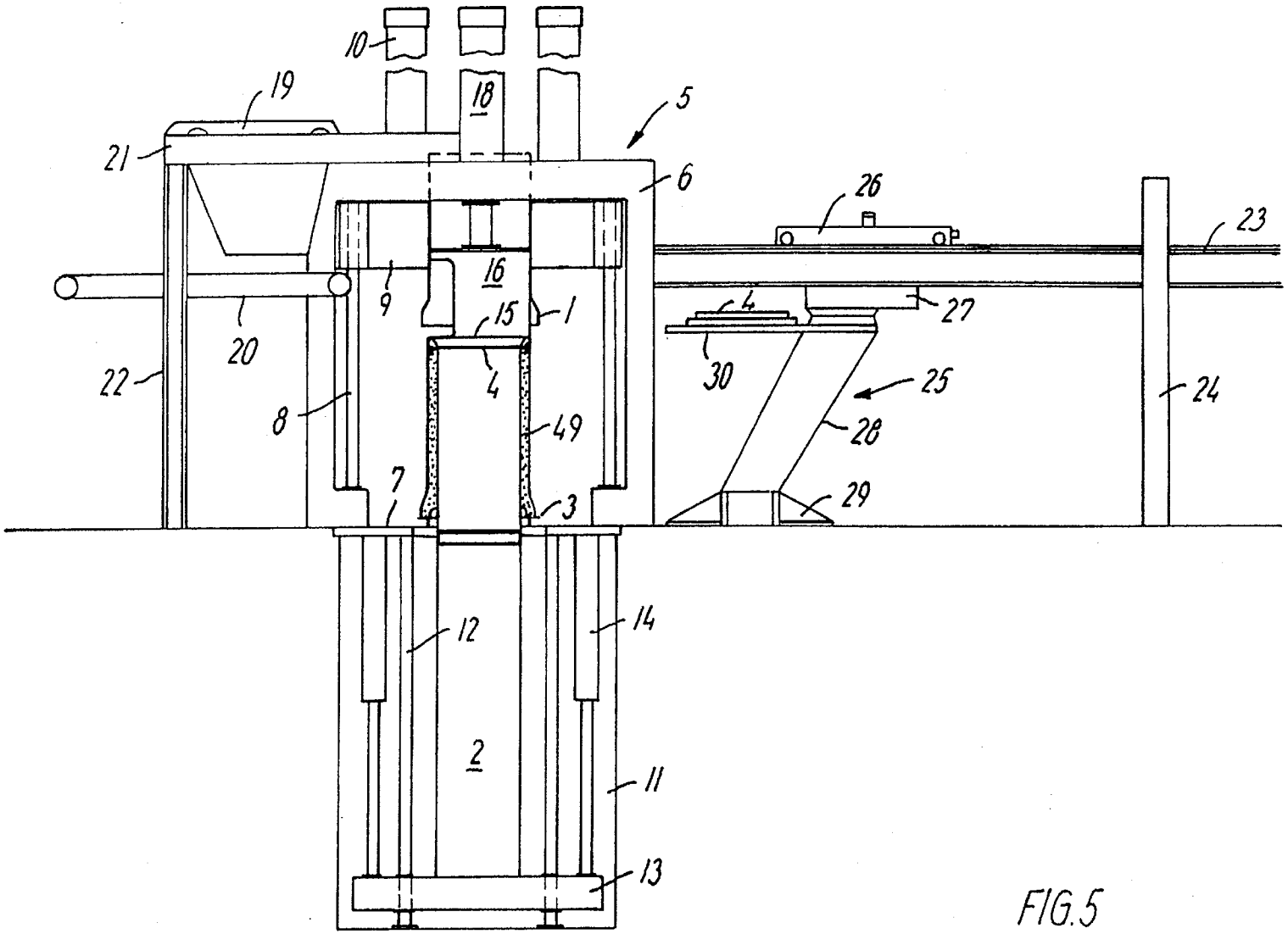
FIG. 5 is a view similar to FIG. 1 showing the apparatus in a position where the stripping operation has been completed.

In FIG. 5 the stripping operation has been completed. The inner mould 2 has again been pulled completely down into the pit 11, and the outer mould 1 is present in its upper free position, which permits the cast pipe to be freely removed from the casting area. However, the chuck 15 with the top ring 4 is still in the casting position.

Figure 6:
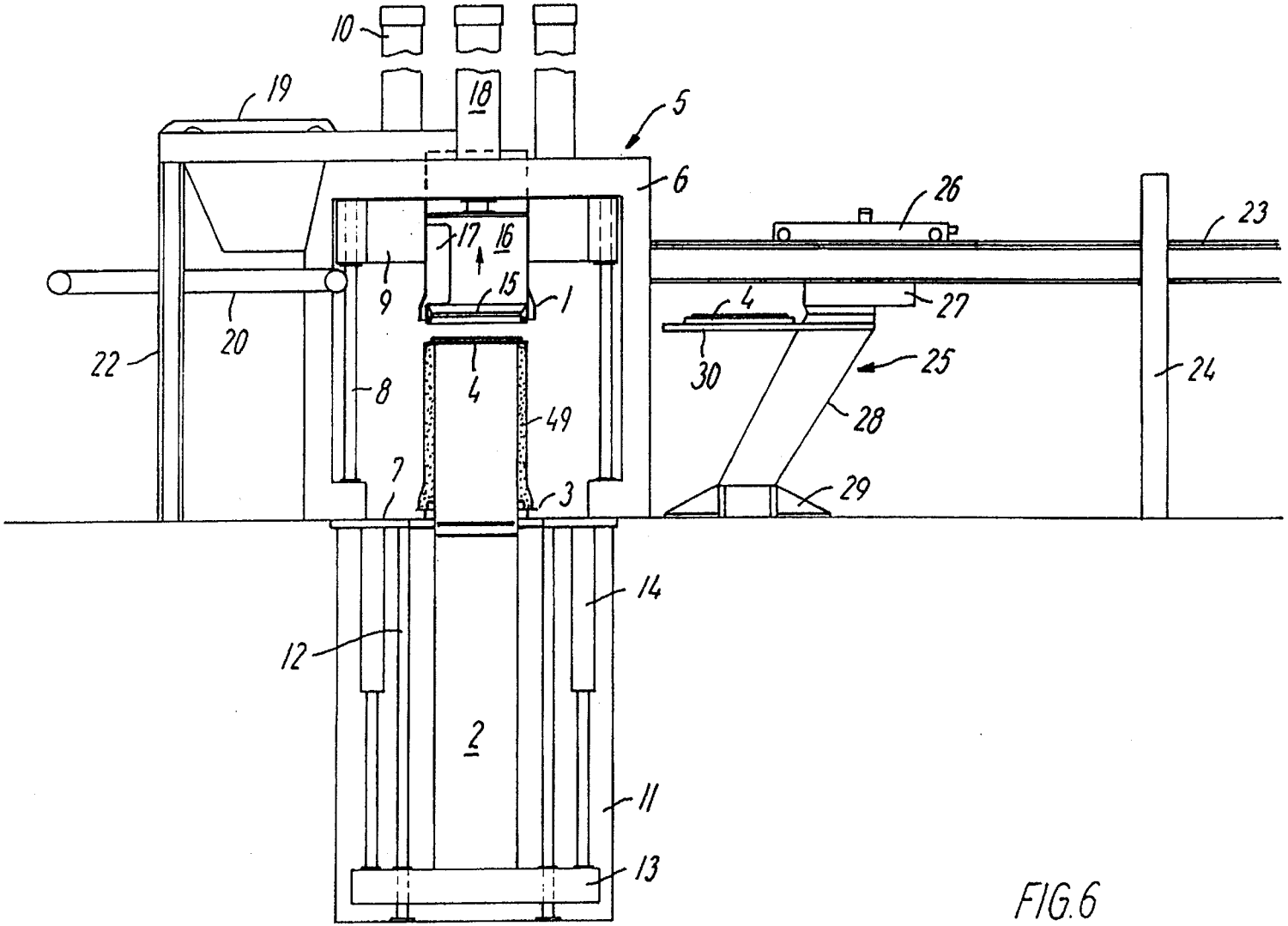
FIG. 6 is a view similar to FIG. 1, showing the clamping chuck being pulled up.

In FIG. 6 the second valve 67 associated with the drop safety device 56 has now opened, and if, as is usually the case, the system is pressurized, the hook 60, which in the casting position is in the position shown in FIG. 13, will be rotated clear of the edge flap 34 of the top ring, as shown in FIG. 11. Then the first valve 45 closes, and the pressure in the hose 35 is relieved, whereby the clamping chuck releases the gripping ring 33 of the top ring. Then the clamping chuck 15 is pulled up, as shown by the arrow, while the top ring 4 is left on the spigot end of the cast pipe 49, where the top ring, as mentioned before, remains until the concrete has set sufficiently.

Figure 7:
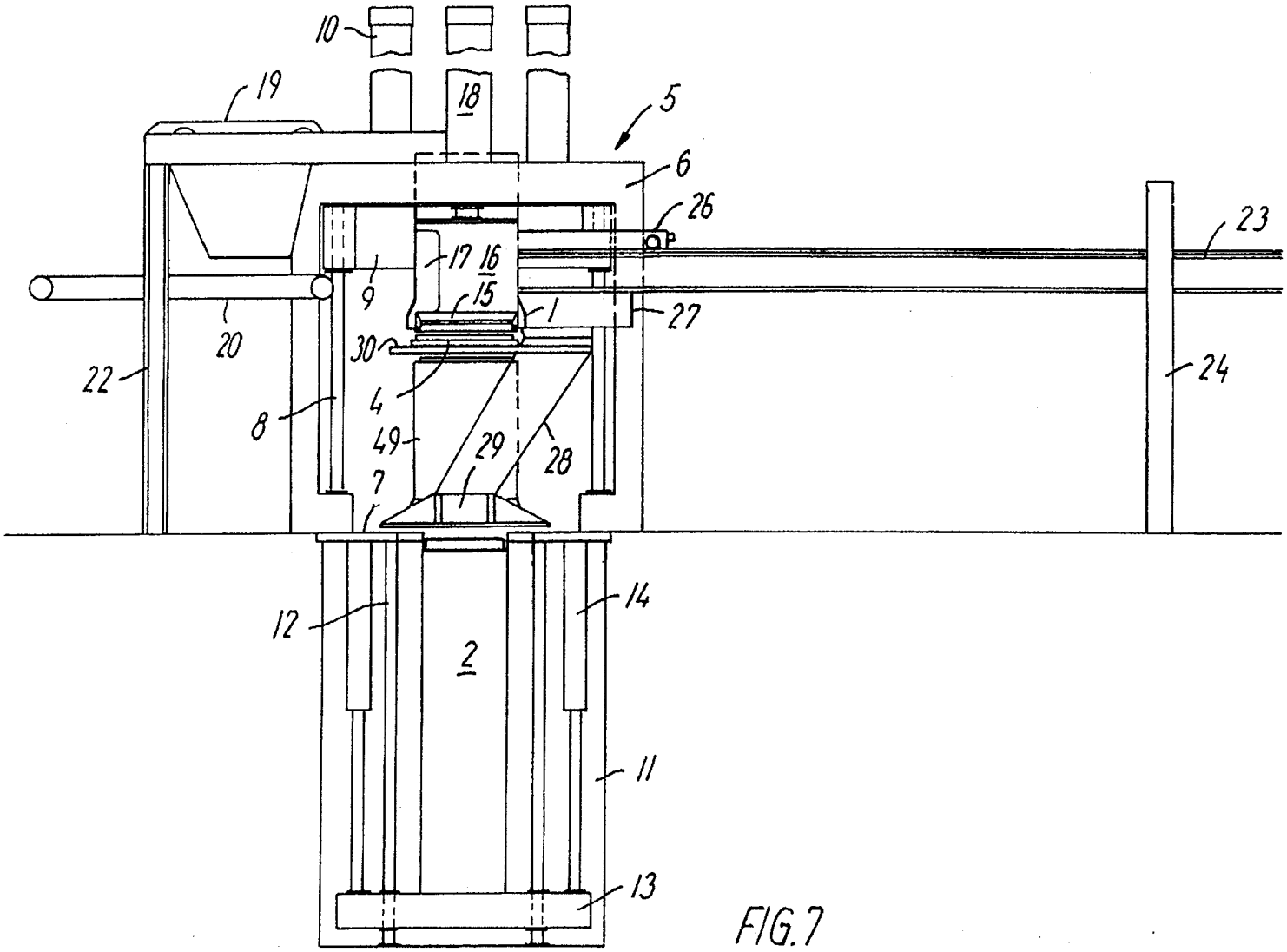
FIG. 7 is a view similar to FIG. 1 showing the pipe crane in position to remove a finished cast pipe.

In FIG. 7 the pipe crane 25 has now been driven into position for fetching the finished pipe. The forks 29 of the pipe crane have been moved below the bottom ring 3, which simultaneously serves as a pallet for the pipe. The new top ring 4, which is placed on the shelf 30, has simultaneously been positioned below the clamping chuck 15.

Figure 8:
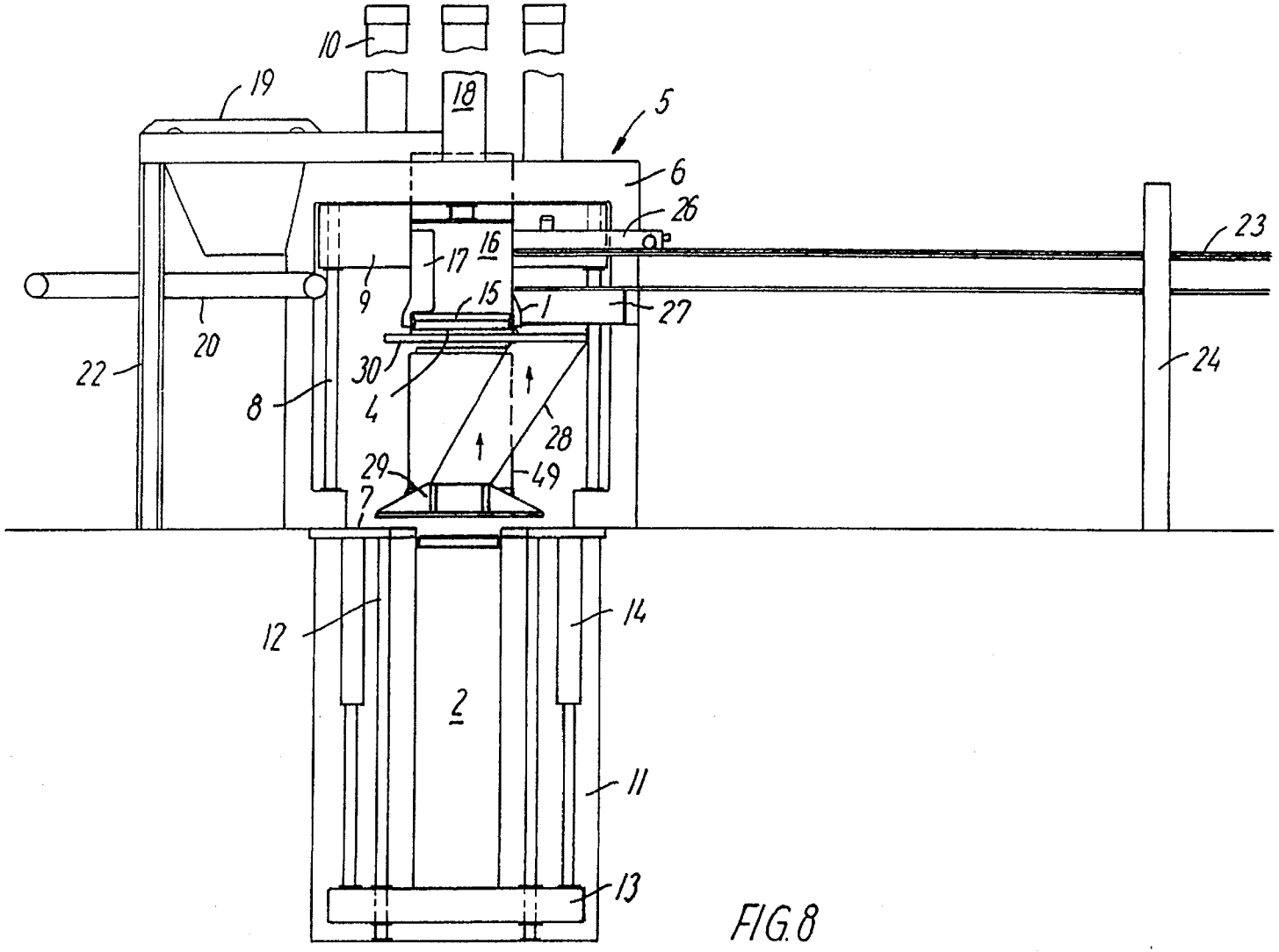
FIG. 8 is a view similar to FIG. 1 showing the pipe crane in the process of lifting the cast pipe clear of the table.

In FIG. 8 the pipe crane 25 is in the process of lifting the pipe clear of the table 7 by means of the lifting mechanism 27, and the chuck 15 has simultaneously been lowered to grip the new top ring 4.

Figure 9:
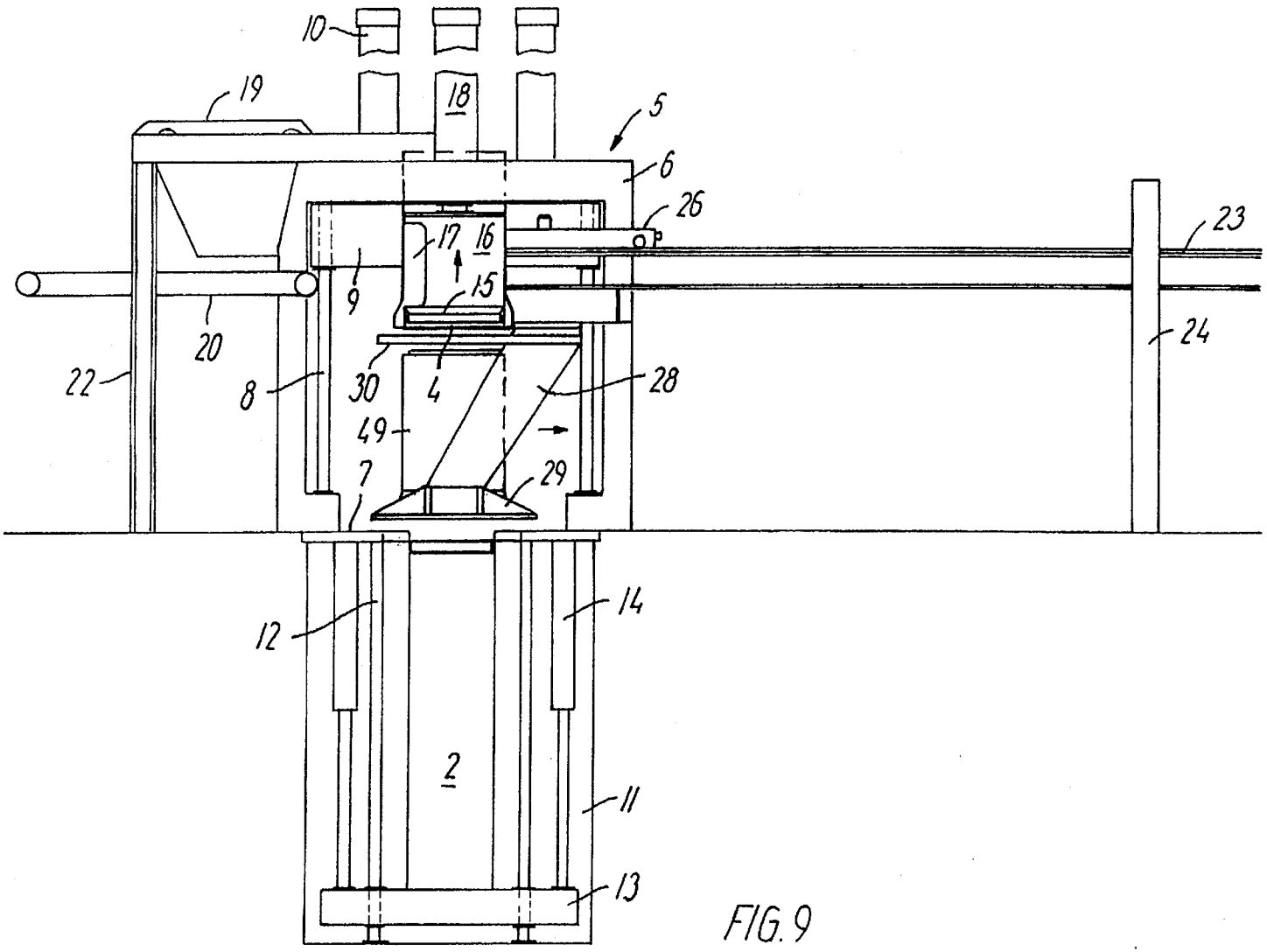
FIG. 9 is a view similar to FIG. 1 showing the pipe crane in position to move the cast pipe away from the casting area of the apparatus.

In FIG. 9 the chuck 15 has finally lifted the top ring clear of the shelf 30, and the pipe crane 25 is ready to drive the cast pipe away from the casting area in the direction of the arrow. A new production cycle can begin, as shown in FIG. 1.

An exemplary embodiment of the production system for the casting of just one pipe per production cycle is shown in the drawing and is described above. It goes without saying that the scope of protection of the invention is not restricted to this, and that production systems casting several pipes in one and the same production cycle are conceivable.

I claim:

1. Apparatus for the casting of a cylindrical hollow body in an upright position comprising an inner cylinder mold, an outer cylindrical mold, means for displacing the outer mold vertically up and down between a lower casting position for casting the hollow body where the outer mold is disposed concentrically around the outside of the inner mold and an upper free position, a bottom ring for supporting and molding a lower end part of the hollow body, a top ring for molding an upper end part of the hollow body, a cylindrical jacket-shaped gripping ring extending vertically upward from the top ring, the lower end of the gripping ring being secured to the top ring and the upper end thereof being free, a gripper for gripping and bringing the top ring into a molding position and retaining the top ring in said molding position during casting of the hollow body, said gripper including a clamping chuck having an opening for receiving said gripping ring, clamping means for clamping the chuck around the gripping ring and means for displacing the clamping chuck vertically up and down between a lower casting position where the top ring is in said molding position and an upper free position, the largest transverse dimension of said clamping chuck being smaller than the internal diameter of the outer mold.

2. The apparatus of claim 1, including means for raising the inner mold vertically during casting of the hollow body and lowering the inner mold to a lower free position after casting of the hollow body.

3. The apparatus of claim 1, wherein the clamping chuck comprises an inner ring and an outer ring and the clamping means comprises a ring-shaped, flexible hose arranged substantially co-axially between said inner and outer rings, said ring-shaped hose being supported by an inwardly directed face of the outer ring, means for expanding the hose with a source of pressurized fluid, and a spring ring located between said inner ring and said ring-shaped hose, said spring ring defining with said inner ring the opening of the clamping chuck for receiving the gripping ring of the top ring, and having an open, transverse extending gap along a part of a periphery thereof that is wide enough to allow the diameter of the spring ring to be reduced during expansion of the ring-shaped hose and the clamping of the gripping ring of a top ring between the spring ring and the inner ring, said spring ring being biased to expand outwardly against the ring-shaped hose to deflate the hose and permit the gripping ring to be unclamped from the clamping chuck when the hose has been relieved of its source of pressurized fluid.

4. The apparatus of claim 3, including a valve located between the source of pressurized fluid and the hose for alternately connecting the hose with either a high pressure side or a low pressure side of said source, the valve connection to the low pressure side having a considerably smaller flow area than a cross-sectional area of the, hose in an expanded state.

5. The apparatus of claim 3, wherein nowhere along the circumference thereof is the spring ring firmly connected with the chuck.

6. The apparatus of claim 4, wherein the spring ring is secured to a part of the chuck at a location diametrically opposite said gap, said part being aligned with said valve connection.

7. The apparatus of claim 3, wherein said outer ring of the clamping chuck has an upwardly directed engagement face for supporting said spring ring.

8. The apparatus of claim 3, wherein the opening of the clamping chuck is ring-shaped, the inner ring having a height greater than the gripping ring and a smaller outside diameter than the inside diameter of the gripping ring.

9. The apparatus of claim 3, including a relatively thin-walled, plate-shaped ring section covering an outer side of the transverse gap of the spring ring.

10. The apparatus of claim 3, wherein the top ring includes a plate ring on an upper side thereof and to which the gripping ring is secured, said plate ring having an outwardly and upwardly extending free edge flap.

11. The apparatus of claim 10, including a catch on an outer periphery of the clamping chuck that is retained in position by a spring means below the edge flap of the plate ring on the top ring when the gripping ring is received in the clamping chuck, said catch being movable to an out of the way position by a pressure fluid drive cylinder by opening a valve to connect the drive cylinder with the source of pressurized fluid for the ring-shaped hose.

12. The apparatus of claim 1, wherein the means for displacing the clamping chuck comprises a vertically displaceable filling pipe having a smaller outer diameter than the inside diameter of the outer mold, said filling pipe having a lateral opening for introducing casting material between said molds in the casting position and said clamping chuck being secured to a lower end of said filling pipe.

13. The apparatus of claim 1, including a pipe crane having a fork for gripping below the bottom ring and removing a hollow cast body standing on it from the casting position, said pipe crane having a shelf on which a top ring can be placed for moving a top ring into position below the clamping chuck of the gripper so that it can be gripped by the clamping chuck when the fork of the pipe crane is in position below the bottom ring.

* * * * *